US006939157B2

(12) United States Patent
Chiu

(10) Patent No.: US 6,939,157 B2
(45) Date of Patent: Sep. 6, 2005

(54) MINI SECURE DIGITAL CARD CONNECTOR

(75) Inventor: Hsien-Yu Chiu, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 0 days.

(21) Appl. No.: 10/806,194

(22) Filed: Mar. 23, 2004

(65) Prior Publication Data

US 2005/0106921 A1 May 19, 2005

(30) Foreign Application Priority Data

Nov. 13, 2003 (TW) ..... 92131861 A

(51) Int. Cl.[7] ..... H01R 13/62
(52) U.S. Cl. ..... 439/328
(58) Field of Search ..... 439/328, 630, 439/633

(56) References Cited

U.S. PATENT DOCUMENTS 3,803,533 A * 4/1974 Taplin ..... 439/328
6,663,407 B1 * 12/2003 Pickles ..... 439/328
2004/0043664 A1 * 3/2004 Sato et al. ..... 439/630

* cited by examiner

*Primary Examiner*—Renee Luebke

(57) ABSTRACT

A mini Secure Digital (SD) card connector includes an insulation body, a pair of clamping arms and eleven insertion terminals. The insulation of the connector has an open recess and a protective structure, and is for accommodating a signal contact portion of the mini SD card. To appropriately place the signal contact portion in correct directions, the insulation further has retaining ribs for retaining guiding track portions of the mini SD card, and block members of the clamping arms for fastening with breaches of the mini SD card, thereby steadily locating the mini SD card in the open recess of the insulation body of the connector.

6 Claims, 7 Drawing Sheets

MINI SECURE DIGITAL CARD CONNECTOR

BACKGROUND OF THE INVENTION (a) Field of the Invention

The invention relates to a flash memory card connector, and more particularly, to a connector tailored for mini Secure Digital (SD) cards.

(b) Description of the Prior Art

A mini Secure Digital (SD) card has dimensions of 20 mm×21.5 mm×1.4 mm, and an area of approximately a half of that of a thumb. It has eleven signal lines and a storage capacity of 256 megabytes (MB). Thus, compared to a standard SD card having dimensions of 32 mm×24 mm×2.1 mm, a mini SD card is much smaller, and can save up to more than 40% with respect to an area required for printed circuit board (PCB) and even up to more than 60% with respect to a volume required when being applied to portable devices. Also, the two additional signal lines are reserved for future expansions; for example, antenna connection for short-distance wireless communications with non-contact integrated circuits.

Being capable of saving significant area and volume required owing to a small size and a light volume, this type of mini SD card is adapted and suitable for handheld electronic devices such as mobile phones that need mass data storage. Furthermore, SD interfaces used by current mobile phones are the same as SD interfaces used by the SD cards, and compatibility for both hardware and software is offered. Therefore, the U.S Secure Digital Association has already recognized standard specifications of mini SD flash cards to the public, and established standard specifications of mini SD flash cards as future extensions of current SD cards.

When adopting the mini SD card for data storage, new-type mobile phones are allowed with expanded memory storage for providing multimedia functions including digital static camera (DSC), video capturing, MP3 player, computer games, personal information management (PIM), email and voice-mail, and internet communications. Above all, the mini SD cards come in small sizes and light weights that conform to requirements as mobile phones also need to be small in size and light in volume according to market trends.

In view of the above, to make agreeable to future extensive applications of mini SD cards, the invention proposes a connector devised according to specifications of mini SD cards and tailored especially for mini SD cards.

SUMMARY OF THE INVENTION

Therefore, the primary object of the invention is to provide a connector especially tailor for mini SD cards, which can thereby be extensively applied to multimedia mobile phones, digital static cameras (DSC), digital video cameras, MP3 players, recorders and global positioning systems, with the mini SD card utilized for data storage. More particularly, the SD card using the SD card connector according to the invention can be applied to mobile phones for offering the mobile phones with functions of DSC and internet communication.

The secondary object of the invention is to provide a connector especially tailor for mini SD cards; in that the mini SD card capable of economizing operation space of the mini SD card comprises an insulation body, a pair of clamping arms and eleven insertion terminals. According to standard specifications of a mini SD card, the insulation body of the connector is provided with an open recess having a protective structure and for accommodating a signal contact portion of the mini SD card, so as to appropriately place the signal contact portion of the mini SD card in correct directions. In addition, the insulation body is devised with retaining ribs for retaining guiding track portions of the mini SD card, and also utilizes block members of the clamping arms to fasten with breaches of the mini SD card. Thus, the mini SD card is steadily located in the open recess of the insulation body of the connector and forms good electric connection with the insertion terminals of the connector.

DETAILED DESCRIPTION OF THE PREFERRED EMBODIMENTS

Referring to FIGS. 1 to 5, a mini Secure Digital (SD) card connector 10 according to the invention comprises a longitudinal insulation body 20, a pair of clamping arms 30 and eleven insertion terminals 40.

Figure 7:
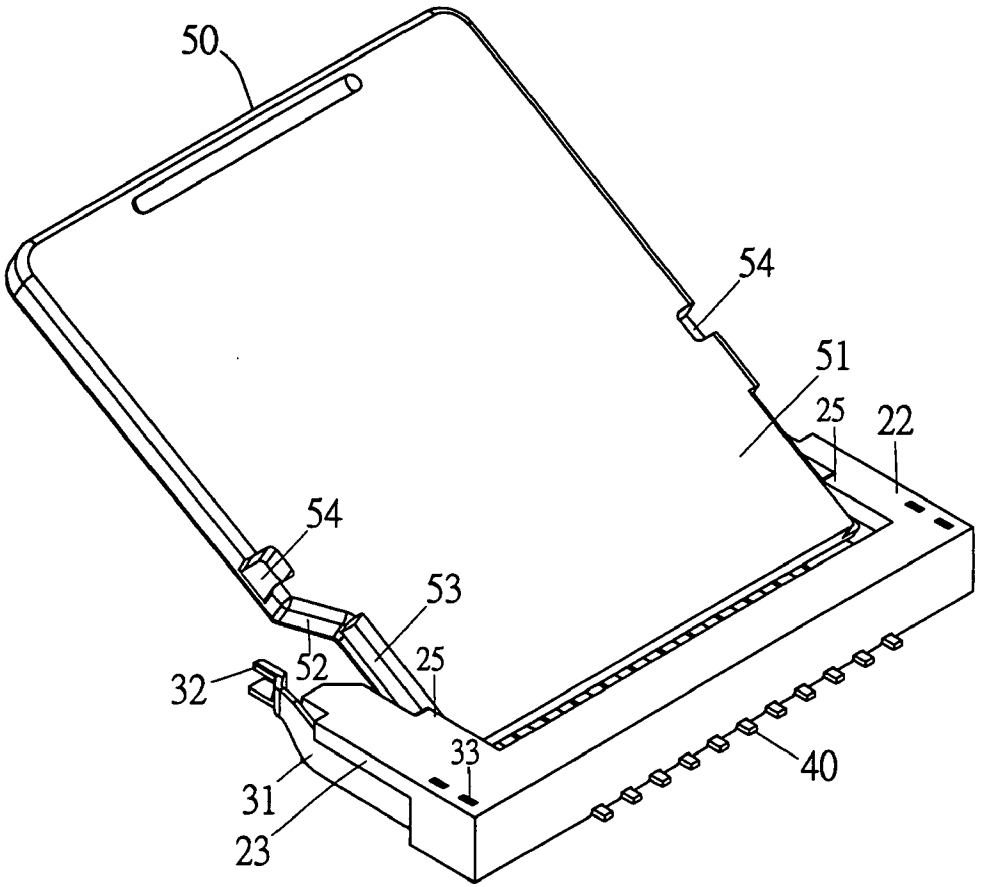
FIG. 7 shows a schematic view of the mini SD card being inserted to the mini SD card connector according to the invention.
Figure 8:
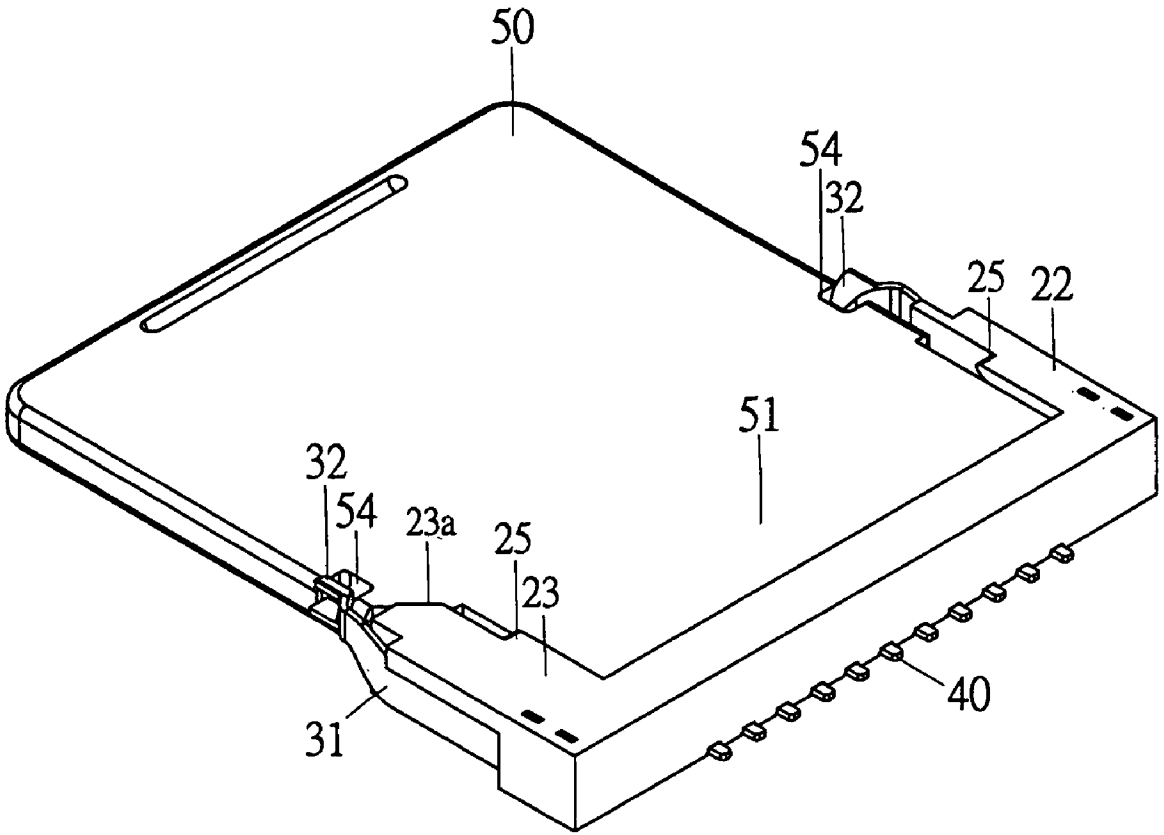
FIG. 8 shows a schematic view the mini SD card connector being applied to the mini SD card according to the invention.

The insulation body 20 has an exposed open space forming an open recess 21. Referring to FIGS. 7 and 8, the open recess 21 is for placing a signal contact portion 51 of a mini SD card 50.

Figure 2:
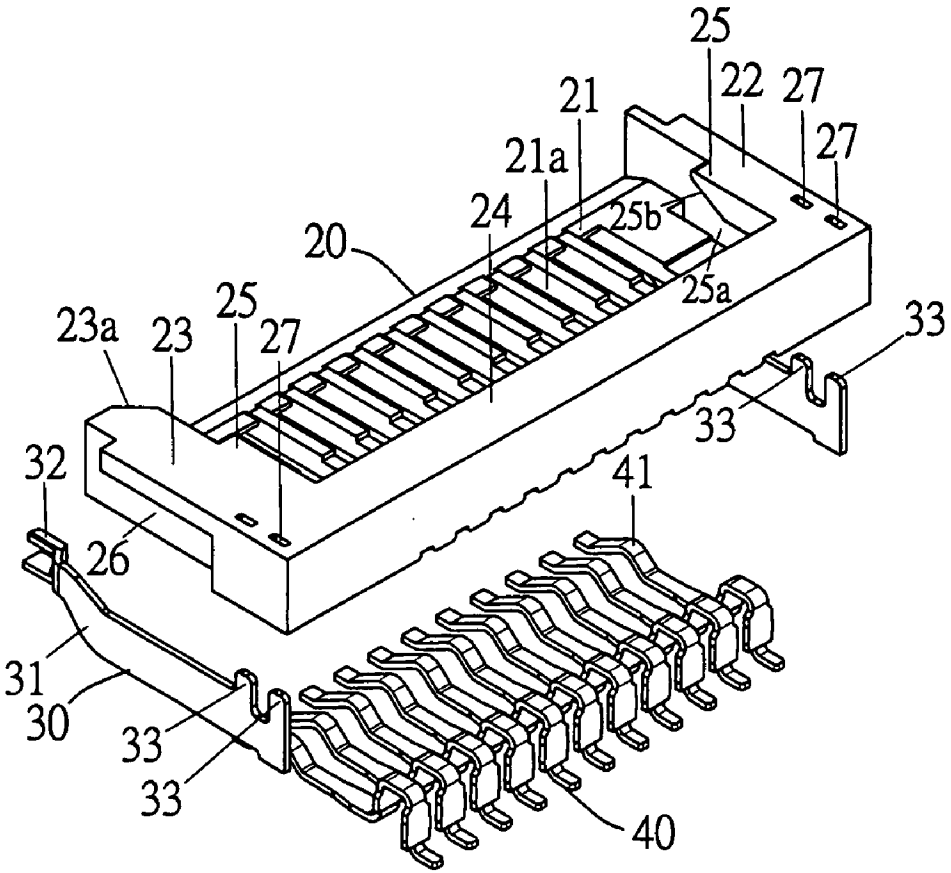
FIG. 2 shows an exploded view illustrating parts of the mini SD card connector according to the invention.
Figure 4:
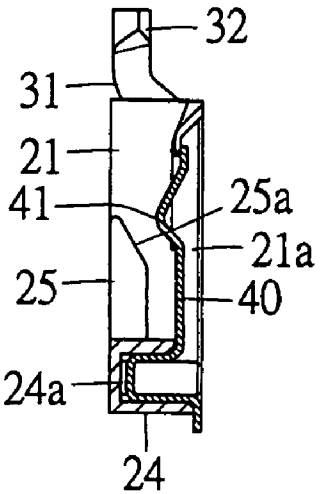
FIG. 4 shows a sectional view of FIG. 3 taken along a sectional line 4—4.

As indicated in FIGS. 2 and 4, the open recess 21 of the insulation body 20 has eleven channels 21*a* formed on one side of the open recess 21, while a rear wall 24 formed on an opposite side of the open recess 21 as provided in the mini SD card connector 10, which has eleven insertion channels 24*a* at positions corresponding to the eleven channels 21*a*. The channels 21*a* and the insertion channels 24*a* are all for inserting and accommodating the eleven insertion terminals 40. When the eleven insertion terminals 40 are located at the insulation body 20, a front bent portion 41 of each insertion terminal 40 is extended out of a surface of the open recess 21 of the insulation body 20. As shown in FIG. 4, a front section of each insertion terminal 40 appears as a suspended arm structure. The front bent portion 41 of each insertion terminal 40 is provided with elasticity.

Referring to FIG. 7, to provide the mini SD card 50 with a protective structure, one side of the signal contact portion 51 is devised with a wedge-shaped plane 52 having a notch. Thus, according to directions indicated in FIG. 7, a left side wall 22 and a right side wall 23 of the insulation body 20 are formed as ribs extended upward with a certain height at two sides of the open recess 21 of the insulation body 20. However, for coordinating with the protective structure of the mini SD card 50, the left side wall 22 and the right side wall 23 are made into unsymmetrical structures. To be more precise, a wall thickness of the right side wall 23 is larger than that of the right side wall 22, and a front end of the right side wall 23 is formed with a wedge-shaped notch 23*a* that corresponds with the wedge-shaped plane 52 of the mini SD card 50. Hence, the signal contact portion 51 of the mini SD card 50 is appropriately placed into the open recess 21 of the insulation body 20.

Figure 1:
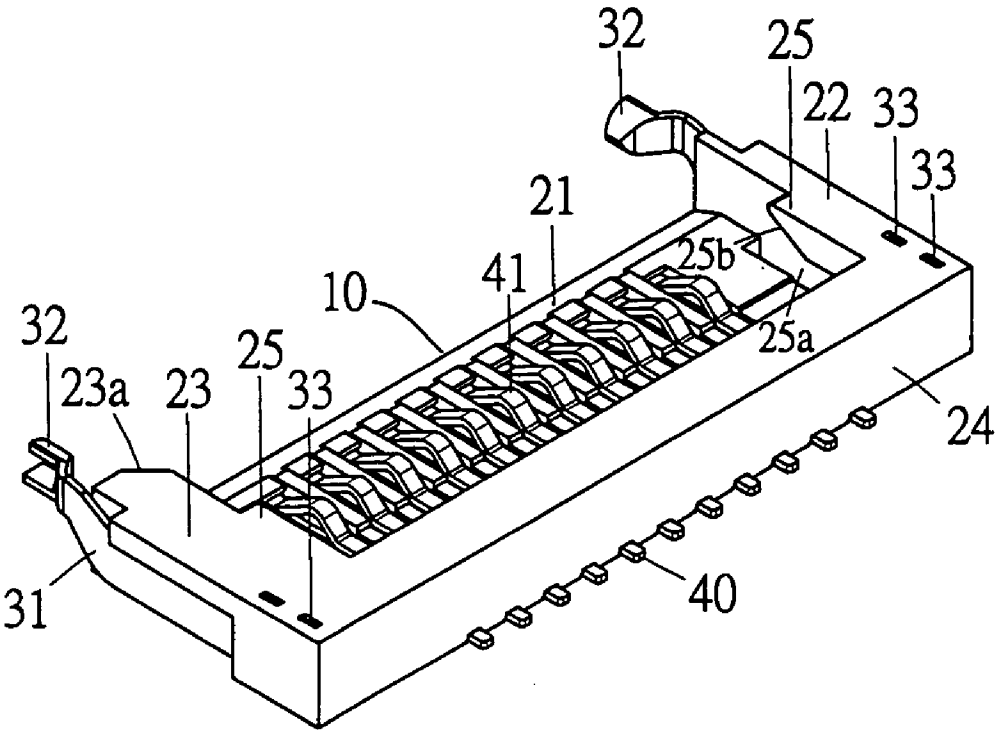
FIG. 1 shows a perspective view of the mini SD card connector according to the invention.
Figure 3:
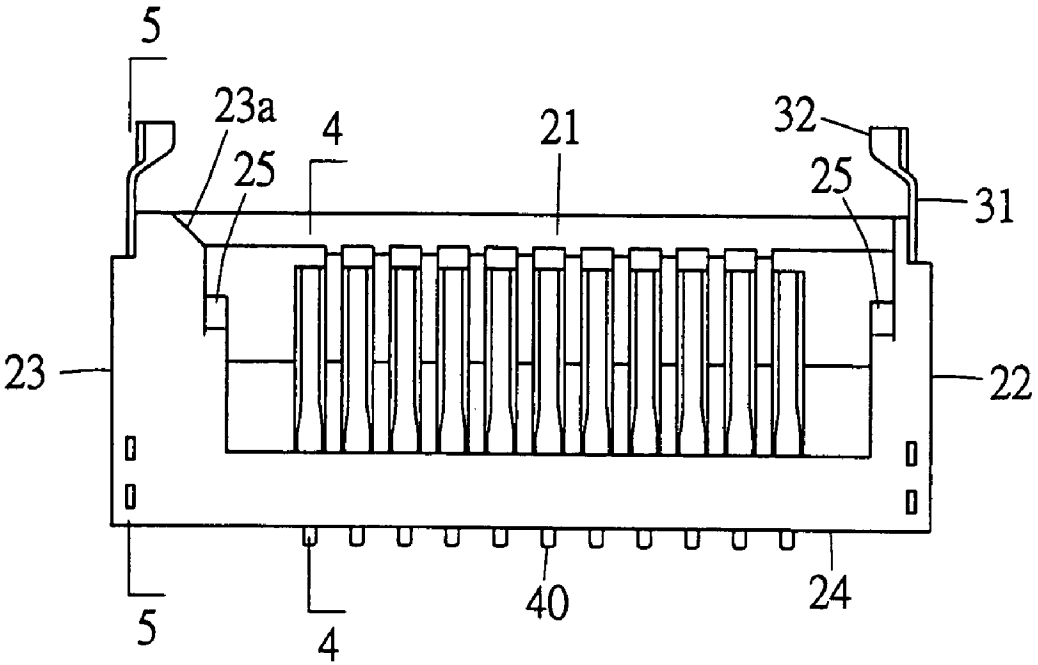
FIG. 3 shows a top view of the mini SD card connector in FIG. 1.

Referring to FIG. 7, according to standard specifications of the mini SD card 50, exposed guiding track portions 53 having a certain depth are formed at two sides of the signal contact portion 51 of the mini SD card 50. Thus, the mini SD card 50 may be stabilized by the mini SD card connector 10 according to the invention using the guiding track portions 53 at the signal contact portion 51 of the mini SD card 50. Referring to FIGS. 1 to 3, to accomplish the aforesaid effect, an inner surface of each of the left side wall 22 and the right side wall 23 of the insulation body 20 is additionally formed with a bulging retaining rib 25, such that a guiding groove 25*a* is developed by a gap between a lower surface of each retaining rib 25 and the surface of the open recess 21, thereby allowing each guiding track portion 53 of the mini SD card 50 to insert therein without becoming disengaged for being retained by the retaining ribs 25. In addition, a lower front surface of each retaining rib 25 is formed with an inclined indentation 25*b*. The reason behind the above structure is that, when inserting the guiding track portions 53 of the mini SD card 50 into the guiding grooves 25*a* at lower portions of the retaining ribs 25, the guiding track portions 53 are first aligned with the guiding grooves 25*a* at lower portions of the retaining ribs 25 in an inclined direction, pushed toward the inclined indentations 25*b*, and forwarded along the guiding grooves 25*a* at lower portions of the mini SD card 50 to finally appear as horizontal. Hence, the guiding track portions 53 of the mini SD card 50 become electrically connected with the front bent portions 41 of the insertion terminals 40. Using the aforesaid design, operation space needed for inserting the mini SD card 50 is economized, so that operation and installation space is also reduced when the structure is applied to mobile phones in the future.

In addition, each outer wall surface of the left side wall 22 and the right side wall 23 is excavated with an inset groove 26 for accommodating the clamping arms 30 therein. A rear portion of each wall surface of the left side wall 22 and the right side wall 23 has a locating groove 27 that is in communication with each of the inset groove 26.

Referring to FIG. 7, according to standard specifications of the mini SD card 50, each of two sides thereof is provided with a breach 54. Therefore, the breaches 54 can be utilized by the mini SD card connector 10 according to the invention to stabilize the mini SD card 50. To accomplish the aforesaid effect, referring to FIGS. 1, 2, 3 and 5, the invention adopts a pair of symmetrical clamping arms 30 each having a long and thin strip 31. Each strip 31 has a front section thereof contracted and bent upward. Each of the clamping arms 30 further has block member 32 protruding outward at an inner front section thereof, and an insertion plate 33 at a rear section of each strip 31.

Figure 5:
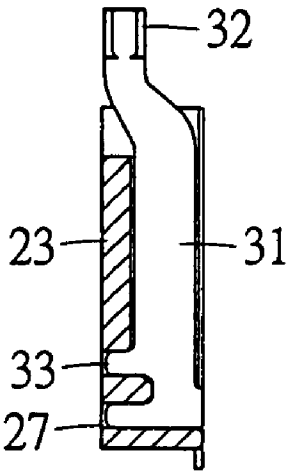
FIG. 5 shows a sectional view of FIG. 3 taken along a sectional line 5—5.

Referring to FIG. 5, using respective insertion plates 33, the pair of clamping arms 30 is inserted into the locating grooves 27 at the left side wall 22 and the right side walls 23 of the insulation body 20. The rear sections of the strips 31 of the clamping arms 30 are fixed in the inset grooves 26 at the left side wall 22 and the right side wall 23, such that the clamping arms 30 are joined with the insulation body to form one structure. The strips 31 formed on the clamping arms 30 are long and narrow in shape, moreover, the front sections of the strips 31 has suspended end portions with slightly restoring elasticity.

Referring to FIGS. 7 and 8, the mini SD card connector 10, apart from using the retaining ribs 25 for retaining the guiding track portions 53 of the mini SD card 50, also utilizes the block members 32 of the pair of clamping arms 30 thereof to fasten with the breaches 54 of the mini SD card 50, such that the mini SD card 50 is steadily located in the mini SD card connector 10.

Figure 6:
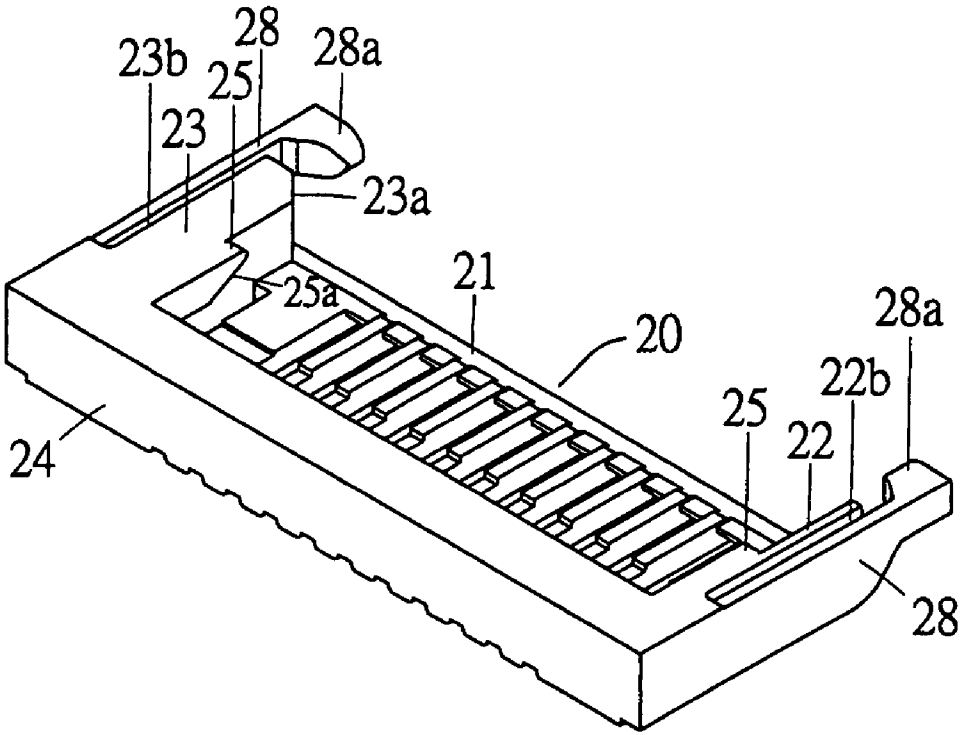
FIG. 6 shows another embodiment of the insulation body 20 according to the invention.
Figure 9:
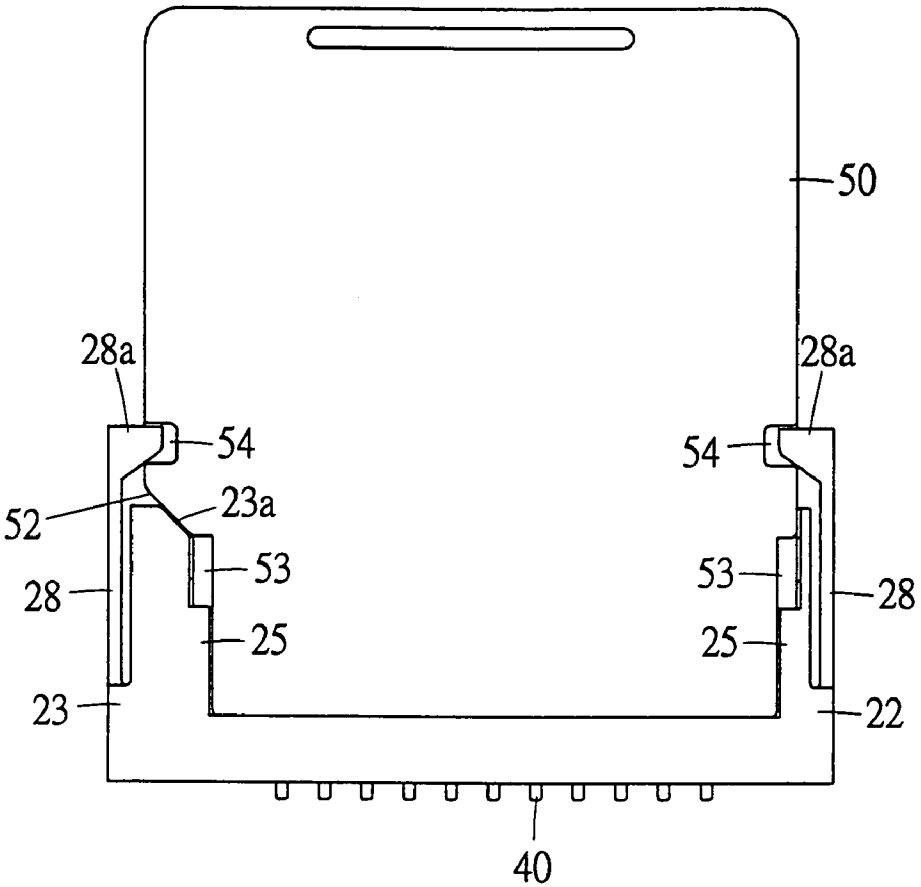
FIG. 9 shows a schematic view of the mini SD card connector as illustrated in FIG. 6 being applied to the mini SD card.

The insulation body 20 according to the invention may have a different structure as in another embodiment. Referring to FIG. 6, each outer wall surface of the left side wall 22 and the right side wall 23 of the insulation body 20 is directly formed with an integral clamping arm 28. Thus, this type of insulation body 20 does not require the aforesaid clamping arms 30. In addition, between the clamping arm 28 of the left side wall 22 and the left side wall 22 is a gap 22*b*, and between the clamping arm 28 of the right side wall 23 and the right side wall 23 is a gap 23*b*. Therefore, a front section of each clamping arm 28 is provided with slight outwardly-pulling and restoring elasticity. Each of the clamping arms 28 further has a cone block member 28*a* protruding outward at an inner front portion thereof. As shown in FIG. 9, the mini SD card connector 10 formed by this type of insulation body 20 still utilizes the retaining ribs 25 for retaining the guiding track portions 53 of the mini SD card 50; however, the block members 28*a* of the clamping arms 28 are adopted for fastening with the breaches 54 of the mini SD card 50.

Referring to FIGS. 7 and 8, the mini SD card connector 10 according to the invention is soldered to a PCB of a mobile phone, so as to enable the mobile phone to store data using the mini SD card 50. The mini SD card 50 is inserted with an angle into the mobile phone, thereby economizing operation space of the mini SD card 50 as well as facilitating operations of a user.

To put the invention to use, referring to FIG. 7, the wedge-shaped plane 52 of the mini SD card 50 is first aligned with the wedge-shaped notch 23*a* at the left side wall 23 of the mini SD card connector 50, and the guiding track portions 53 of the mini SD card 50 are inserted at an angle into the inclined indentation 25*b* at the retaining ribs 25 of the insulation body 20. The mini SD card 50 is guided in along the guiding grooves 25*a* at the retaining ribs 25, and then reaches a horizontal state when further pushed in. At this point, two sides of the mini SD card 50 are butted against the block members 32 of the clamping arms 30 of the mini SD card 10. Since the block members 32 appear as cones, when the two sides of the SD card 50 continue to move downward, the block members 32 of the clamping arms 30 are simultaneously fastened into the breaches 54 at the mini SD card 50 owing to restoring elasticity thereof. As a result, the mini SD card 50 is appropriately placed into the open recess 21 of the insulation body 20, thereby forming good electric connection with the signal contact portion 51 of the min SD card 50 and the insertion terminals 40 of the mini SD card connector 10.

To withdraw the mini SD card 50, by merely applying outward pulling forces, the mini SD card 50 can be removed and disengaged from the block members 32 of the clamping arms 30. When being pulled out, the mini SD card 50 receives restoring forces imposed by the front bent portions 41 of the insertion terminals 40, and hence the mini SD card 50 is slightly slanted upward to be easily removed at an angle.

Using the aforesaid structures, the mini SD card 50 according to the invention, when being applied to a mobile phone, is capable of storing mass data need for multimedia functions such as DSC, video capturing, MP3 playing and internet communication.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A mini Secure Digital (SD) card connector comprising a longitudinal insulation body, a pair of clamping arms and a plurality of insertion terminals; wherein:

left and right side walls of the insulation body are unsymmetrical structures, wherein a front section of the side wall having a larger thickness forms a wedge-shaped notch, each inner surface the left and right side walls is formed with a protruding retaining rib having a guiding groove at a lower portion thereof, and each of outer surface of the left and right side walls is formed with an inset groove;

the pair of clamping arms appears as symmetrical structures each having a long and narrow strip, and each strip has a front section thereof and a rear section thereof accommodated in each of the inset grooves at the two side walls of the insulation body, with front ends of the strips extended out of the two side walls of the insulation body;

and the plurality of insertion terminals is inserted and located in the insulation body.

2. The mini SD card connector in accordance with claim 1, wherein each of the retaining ribs at the two side walls of the insulation body forms an inclined indentation at a lower front end thereof.

3. The mini SD card connector in accordance with claim 2, wherein an end portion of the rear section of each clamping arm is provided with an insertion plate projecting upward, and each of the two side walls of the insulation body is provided with a locating groove for accommodating each of the insertion plates.

4. The mini SD card connector in accordance with claim 1, wherein an end portion of the rear section of each clamping arm is provided with an insertion plate projecting upward, and each of the two side walls of the insulation body is provided with a locating groove for accommodating each of the insertion plates.

5. A mini SD card connector comprising a longitudinal insulation body, a pair of clamping arms and a plurality of insertion terminals; wherein:

left and right side walls of the insulation body are unsymmetrical structures, wherein a front section of the side wall having a larger thickness forms a wedge-shaped notch, each inner surface of the left and right side walls is formed with a protruding retaining rib having a guiding groove at a lower portion thereof, and each outer surface of the left and right side walls is formed with an integral clamping arm, with an end portion of each front section of the clamping arms respectively extended out of the two side walls of the insulation body;

the plurality of insertion terminals is inserted and located in the insulation body.

6. The mini SD card connector in accordance with claim 5, wherein a lower front surface of each retaining rib at two side walls of the insulation body is formed as an inclined indentation.

* * * * *